United States Patent [19]

Obländer et al.

[11] Patent Number: 4,528,950

[45] Date of Patent: Jul. 16, 1985

[54] CYLINDER/CRANK CASING IN CAST IRON FOR INTERNAL COMBUSTION ENGINES

[75] Inventors: Kurt Obländer, Kernen; Wolfram Dahm, Nürtingen, both of Fed. Rep. of Germany

[73] Assignee: Daimler-Benz Aktiengesellschaft, Stuttgart, Fed. Rep. of Germany

[21] Appl. No.: 539,553

[22] Filed: Oct. 6, 1983

[30] Foreign Application Priority Data

Oct. 16, 1982 [DE] Fed. Rep. of Germany ..... 3238440

[51] Int. Cl.[3] ..... F02F 1/00

[52] U.S. Cl. ..... 123/193 C; 123/669; 123/193 CP

[58] Field of Search ..... 123/668, 669, 193 R, 123/193 C, 193 CP; 277/237 R, DIG. 6

[56] References Cited

U.S. PATENT DOCUMENTS 3,808,955 5/1974 Hamada et al. ..... 123/193 C
4,393,821 7/1983 Urano ..... 123/668

FOREIGN PATENT DOCUMENTS 0114525 2/1942 Australia ..... 123/193 C

*Primary Examiner*—Craig R. Feinberg
*Attorney, Agent, or Firm*—Barnes & Thornburg

[57] ABSTRACT

A cylinder casing for use in internal combustion engines having a reciprocating piston is provided having strip-shaped hardened zones along the inner wall of the cylinder which are disposed in such a manner as to impart rotational movement to piston rings relative to the piston sliding within that cylinder.

10 Claims, 5 Drawing Figures

CYLINDER/CRANK CASING IN CAST IRON FOR INTERNAL COMBUSTION ENGINES

BACKGROUND AND SUMMARY OF THE INVENTION

The present invention relates generally to internal combustion engines and, more particularly, to cast iron cylinder or crank casings for such engines with at least a portion of the cylinder inner wall being hardened.

Cylinder or crank casings formed from cast iron are known generally in the prior art. In particular, German Pat. No. 3,029,215 shows such a cylinder casing wherein the inner wall of the cylinder has fine fluting thereon. This cylinder wall is partially hardened at the bottom regions of the grooves of that fluting. This shaping of the cylinder inner wall is intended to ensure favorable running-in properties, good adhesion of the lubricating oil film, and good wear resistance. However, this fine fluting does not impart rotational movement to the piston rings relative to the piston as the piston reciprocates through the cylinder.

It is an object of the present invention to provide a piston cylinder which provides secure sealing and even wear.

Another object is the provision of a cylinder which imparts rotational motion to piston rings with respect to the piston.

A further object is to provide a cylinder wall which ensures piston sealing and even piston ring wear by imparting rotational motion to the piston rings in response to reciprocating motion of the piston head.

These and other objects of the present invention are achieved by the provision of a cylinder means, for use in an internal combustion engine, having strip-shaped hardened zone means on its internal walls. These zone means are disposed obliquely to the cylinder generator lines and serve to impose rotational movement on the piston ring means as the piston head slides through the cylinder means.

The strip-shaped hardened zone means always remain somewhat raised after fine machining of the inner wall of the cylinder means. These zone means present a steep, tread-like guidance to the piston ring means so that the rings rotate relative to the piston during both stroke directions of the piston. Because of the varying pressure loading during the individual piston strokes, these rotational motions may be different in each case. The net result, however, is that the piston ring means are evenly loaded over their periphery.

The strip-shaped zone means can form straight or curved strips along the cylinder means inner wall. These strips may be continuous or formed from a series of discrete hardened points. The zone means may be evenly distributed over the inner periphery of the cylinder means wall and may make an angle of between 10° and 30° with respect to the generator lines of the cylinder inner wall. The zone means may extend into the stroke region of the first piston ring of each piston.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
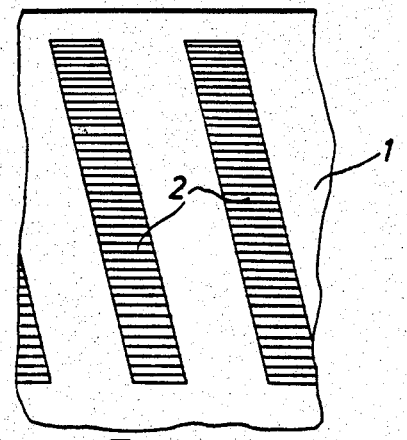
FIG. 1 shows a portion of a cylinder wall having strip-shaped hardened zones formed as relatively wide strips according to the present invention.

FIG. 1, which illustrates a preferred embodiment of the present invention, shows an inner cylinder means or crank casing wall 1 having hardened zone means 2 formed as relatively wide, straight strips thereon. This cylinder means or crank casing means may, for example, be formed from cast iron and may be employed in an internal combustion engine having a reciprocating piston within that cylinder means. Strip zone means 2 may be, for example, evenly distributed over the periphery of cylinder means wall 1 and each strip thereof disposed at an angle of 10° to 30° with respect to the generator lines of the cylinder wall (i.e., the lines of travel of the piston along the cylinder wall at that point). Strip zone means 2 may extend the length of cylinder means wall 1 within the stroke region of at least the first piston ring means of the piston.

Figure 2:
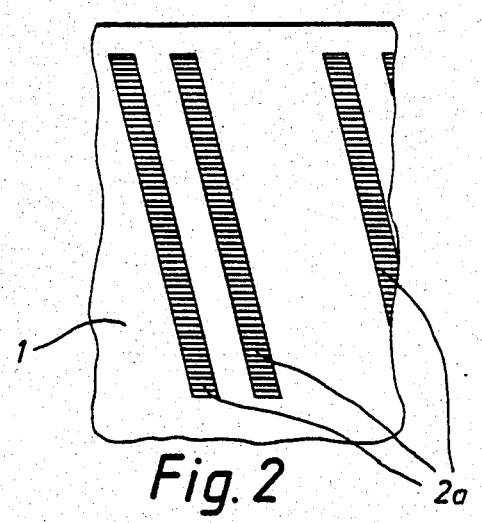
FIG. 2 shows a portion of a cylinder wall having strip-shaped hardened zones formed as relatively narrow hardened zones according to another embodiment of the present invention.

FIG. 2 illustrates another embodiment of the present invention wherein hardened zone means **2*a* form narrower straight strips than those corresponding strips shown in FIG. 1. Zone means 2*a* may be distributed about the periphery of cylinder means inner wall 1 in paired relation such that a relatively large space is provided between strip pairs of zone means 2*a* and a relatively small space is provided between strips of such pairs of zone means 2*a***.

Figure 3:
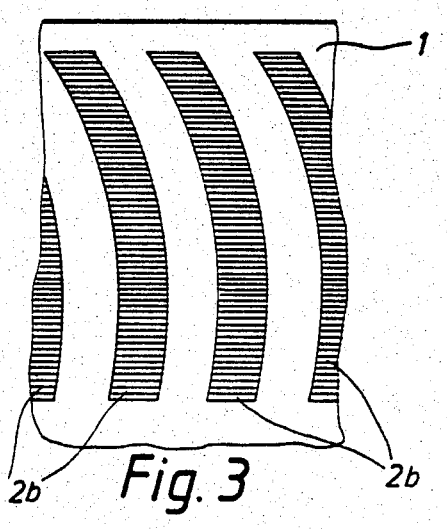
FIG. 3 shows a portion of a cylinder wall having strip-shaped hardened zones formed as relatively wide curved strips according to a further embodiment of the present invention.
Figure 4:
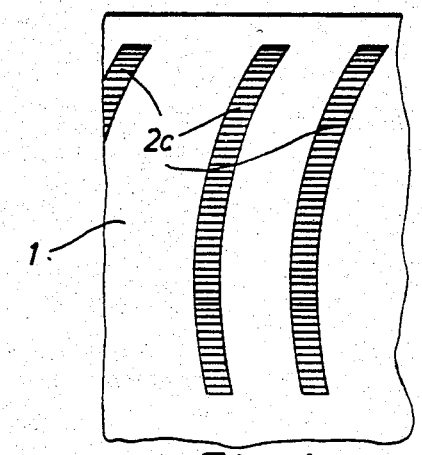
FIG. 4 shows a portion of a cylinder wall having strip-shaped hardened zones formed as relatively narrow curved strips according to a still further embodiment of the present invention.

FIG. 3 illustrates a further embodiment of the present invention wherein hardened zone means **2*b* form curved strips of a relatively large width, such as that of zone means 2 in FIG. 1. Likewise, zone means 2*b* may, for example, be evenly distributed about the periphery of cylinder means inner wall 1. FIG. 4 illustrates yet another embodiment of the present invention wherein hardened zone means 2*c* form strips which are curved in a direction opposite to the curve of zone means 2*b*** in FIG. 3.

Figure 5:
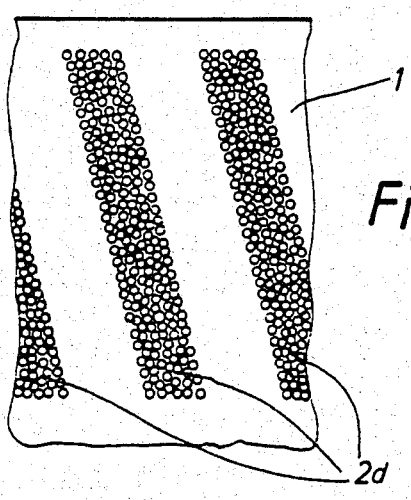
FIG. 5 shows a portion of a cylinder wall having strip-shaped hardened zones formed as straight strips from a plurality of hardened, discrete points according to yet another further embodiment of the present invention.

FIG. 5 illustrates still yet another embodiment of the present invention wherein hardened zone means **2*d* are formed from a plurality of discrete, individual hardened points arranged in adjacent groupings to form strips on cylinder means inner wall 1. Zone means 2*d* may be contrasted with continuous zone means 2, 2*a*, 2*b* and 2*c***.

While we have shown and described only these embodiments in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

What is claimed is:

1. A cylinder means for use in internal combustion engines having a piston means for reciprocating within said cylinder means, the cylinder means having an axial length, the pistion means including at least one piston ring, the cylinder means comprising:

an inner wall, and zone means disposed on the inner wall of the cylinder means for imparting rotational motion to the at least one piston ring when the piston means is reciprocating within the cylinder means, the zone means including a plurality of separate strips positioned on the inner wall and all being inclined in a substantially common angular relation to the generatrix of the cylinder means, said strips being circumferentially spaced-apart from one another at any given transverse cross section along the axial length of the cylinder means.

2. The cylinder casing means according to claim 1, wherein the cylinder means includes a stroke region for the at least one piston ring and said zone means extends in the stroke region.

3. The cylinder means according to claim 1, wherein at least one of the strips is disposed at an angle with respect to a direction of travel of said piston means within said cylinder means.

4. The cylinder means of claim 1, wherein the strips are substantially uniformly spaced apart about the circumference of the inner wall.

5. The cylinder means of claim 1, wherein each strip is inclined along its length at one selected oblique angle in relation to the generatrix of the cylinder means to provide a substantially straight strip.

6. The cylinder means of claim 1, wherein each strip is inclined along its length at an angle of 10° to 30° in relation to the generatrix of the cylinder means to provide a curved strip.

7. The cylinder means of claim 1, wherein each strip is defined by a projection extending from the inner wall into the interior of the cylinder means to provide a substantially continuous piston ring-engaging surface.

8. The cylinder means of claim 1, wherein at least one of the strips are hardened.

9. The cylinder means of claim 1, wherein each strip is defined by an array of discrete members, each member extending from the inner wall into the interior of the cylinder means to provide a series of individual piston ring-engaging points.

10. The cylinder means of claim 1 wherein the discrete members are hardened.

* * * * *